US006971351B2

(12) United States Patent
Kinugawa et al.

(10) Patent No.: US 6,971,351 B2
(45) Date of Patent: Dec. 6, 2005

(54) VALVE TIMING ADJUSTING DEVICE

(75) Inventors: Hiroyuki Kinugawa, Tokyo (JP); Makoto Yamauchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/781,771

(22) Filed: Feb. 20, 2004

(65) Prior Publication Data

US 2004/0182345 A1 Sep. 23, 2004

(30) Foreign Application Priority Data

Mar. 3, 2003 (JP) ..... 2003-056033

(51) Int. Cl.[7] ..... F01L 1/34

(52) U.S. Cl. ..... 123/90.17; 123/90.18; 123/90.15; 123/90.16; 464/1; 464/2; 464/160; 464/161; 92/5 L; 92/23; 92/24; 92/27; 92/121; 92/122; 148/545; 148/547; 148/548

(58) Field of Search ..... 123/90.15–90.18; 74/572, 579 R, 580; 92/5 L, 17, 23, 24, 27, 92/28, 120–125; 464/1, 2, 160, 161; 148/545–548; 29/888.048

(56) References Cited

U.S. PATENT DOCUMENTS

| | | | | |
|---|---|---|---|---|
| 5,724,929 | A * | 3/1998 | Mikame et al. | 123/90.17 |
| 6,352,008 | B1 * | 3/2002 | Matsuoka et al. | 74/572 |
| 6,394,052 | B2 * | 5/2002 | Miyasaka et al. | 123/90.17 |
| 6,497,208 | B2 * | 12/2002 | Miyasaka | 123/90.17 |
| 6,523,511 | B2 * | 2/2003 | Hase | 123/90.17 |

FOREIGN PATENT DOCUMENTS

| | | |
|---|---|---|
| JP | 2000-345815 A | 12/2000 |
| JP | 2002-054407 A | 2/2002 |

* cited by examiner

*Primary Examiner*—Thomas Denion
*Assistant Examiner*—Kyle M. Riddle
(74) *Attorney, Agent, or Firm*—Sughrue Mion, PLLC

(57) ABSTRACT

A region including an engaging hole is given surface treatment such as partial quench hardening by induction hardening for improving surface hardness of the region. The partial quench hardening by induction hardening provides the region with satisfactory mechanical strength or surface hardness enough for resisting deformation of the engaging hole and wear-out of an edge of opening of the engaging hole caused by putting in and out of the lock pin.

6 Claims, 7 Drawing Sheets

VALVE TIMING ADJUSTING DEVICE

BACKGROUND OF THE INVENTION

1. Field of the Invention

The present invention relates to a valve timing adjusting device adjusting opening and closing timing of an intake valve and/or exhaust valve of an internal combustion engine such as an engine (hereinafter referred to as an "engine").

2. Description of the Related Art

Conventionally, a valve timing adjusting device is generally composed of a first rotor connected to a crank shaft as an output shaft of an engine with a power transmitting member such as a chain, and rotating synchronously with the crank shaft, and a second rotor integrally secured on an end face of an intake side camshaft or an exhaust side camshaft, and provided relatively rotatably by only a predetermined angle within the first rotor.

The first rotor is made by integrating a sprocket having a bearing integrally rotating with the camshaft being subjected to rotational driving force of the crankshaft, and slidingly contacting a peripheral surface in proximity of the end face of the intake side or exhaust side camshaft; a case provided adjacent to the sprocket and having a plurality of hydraulic rooms therein; and a cover covering the hydraulic rooms of the case by a plurality first fastening members. Here, each of the plurality of hydraulic rooms of the case is formed by a plurality of shoes radially inwardly projecting into the case.

The second rotor is generally composed of a boss secured on the end face of the intake side or exhaust side camshaft, and a plurality of vanes radially outwardly projecting from the outside of the boss and dividing the hydraulic rooms into an advance side hydraulic room to be subjected to a hydraulic pressure to rotate the second rotor to the advance side and a lag side hydraulic room to be subjected to a hydraulic pressure to rotate the second rotor to the lag side. A first oil passages formed within the intake side camshaft or the exhaust side camshaft is connected to the advance side hydraulic room, and a second oil passage formed within the intake side camshaft or the exhaust side camshaft is connected to the lag side hydraulic room. It is arranged such that the first oil passage and the second oil passage are supplied with oil pumped up from an oil pan by an oil pump via an oil control valve (hereinafter referred to as an OCV), and when the engine is stopped, oil remaining within the advance side hydraulic room and the lag side hydraulic room is returned to the oil pan via the first oil passage, the second oil passage, and the OCV.

Incidentally, in the absence of hydraulic force within the hydraulic rooms when the engine is started, for instance, the shoes of the first rotor and the vanes of the second rotor repeatedly abutted against and separated from each other by an alternating load (reaction force) necessary for opening and closing of the intake or exhaust valve, thereby producing slapping sounds. In order to obviate this drawback, a conventional valve timing adjusting device has been taken a measure that a lock pin is provided in either of the first rotor and the second rotor, and an engaging hole receiving therein an engagement of the lock pin is formed in the other rotor. The lock pin is arranged such that it advances to the engaging hole with drop of hydraulic force, and engages the engaging hole by an urging member resisting the dropped hydraulic force, and that when the hydraulic force built to a predetermined value at which the hydraulic force can resist urging force induced by the urging member, the lock pin retreat from the engaging hole to disengage the engagement therebetween. Thus, the engagement of the lock pin into the engaging hole locks a relative position between the first rotor and the second rotor and enables suppression of production of slapping sounds in the absence of the hydraulic force when the engine is started. Say in addition, positions at which an engaging hole should be formed include a position where the relative position of the second rotor relative to the first rotor most advanced in the direction of rotation of the crankshaft (hereinafter referred to as the most advanced position), a position where the relative position of the second rotor relative to the first rotor most lagged in the direction of rotation of the crankshaft (hereinafter referred to as the most lagged position), and a position located between the most advanced position and the most lagged position (hereinafter referred to as an intermediate position).

The operation of the conventional valve timing adjusting device will now be described below.

First, when the engine is stopped or immediately after the engine is started, the hydraulic pressure in the valve timing adjusting device drops resulted from an action that oil remaining in the advance side hydraulic room and the lag side hydraulic room of the valve timing adjusting device is returned to the oil pan via the first oil passage, the second oil passage, and the OCV. For this reason, oil pressure is dropped and lock pin is engaged the engaging hole by urging force. This state is also referred to as a lock state.)

Then, when the oil pump is activated by starting the engine, oil is supplied from the oil pan to the advance side hydraulic room or the lag side hydraulic room of the valve timing adjusting device via the OCV. When hydraulic pressure of the advance side or the lag side is applied to the lock pin, the lock pin is thrust back against urging force induced by the urging member and pushed out of the engaging hole, which allows the first rotor and the second rotor to relatively rotate by a predetermined angle with the help of the advance side hydraulic pressure or the lag side hydraulic pressure (rotational regulation releasing state. This state is also referred to as a lock releasing state.)

An infinitesimal clearance is left between a peripheral surface of the lock pin and an inner surface of the engaging hole for smoothly engaging thereinto. On this account, an alternating load (reaction force) of the camshaft causes the peripheral surface of the lock pin to repeatedly abut against the inner surface of the engaging hole, which may enlarge an internal diameter of the engaging hole when the engaging hole has poor mechanical strength. In this case, the initially left infinitesimal clearance widens, and thus amplitude of vibrations generated within the infinitesimal clearance becomes larger accompanied therewith, which might produce slapping sounds. Moreover, when the lock pin retreated out of the engaging hole to release the lock, an edge of a tip of the lock pin rubs against that of opening of the engaging hole, which might wear out the edge of the opening of the engaging hole. In this case, when the engaging hole is actually expanded on account of wear-out in the advanced stage, the lock pin accidentally engages into the engaging hole, giving rises to a state where rotations of the first rotor and the second rotor might be regulated.

Japanese Patent Publications JP 2000-345815 A (FIG. 3) and JP 2002-054407 A (FIG. 4) provide a solution that a discrete part of high hardness is press-fitted into the engaging hole so as to improve mechanical strength of the engaging hole.

However, the conventional valve timing adjusting device thus arranged as above is under the necessity to prepare a new discrete part to be press-fitted into the engaging hole, as well as to add a new assembly process for press-fitting the discrete part thereinto. As a result, additional part and process bring about an increase in manufacturing cost and lowering in assembly accuracy.

SUMMARY OF THE INVENTION

The present-invention has been made to solve the above-mentioned problems. An object of the present invention is to provide a valve timing adjusting device being excellent in operation reliability of regulation and release of a relative rotation between a first rotor and a second rotor, without inviting an increase in manufacturing cost and lowering in assembling accuracy caused by addition of new parts and an assembly process for the parts.

A valve timing adjusting device according to the present invention includes a first rotor rotating synchronously with a crankshaft of an internal combustion engine; a second rotor secured on an end face of an intake camshaft of the engine or an exhaust camshaft thereof, and provided relatively rotatably within the first rotor by only a predetermined angle; a rotation regulating member provided within one rotor either of the first rotor and the second rotor, for regulating a relative rotation between the first rotor and the second rotor when the relative position reaches a predetermined position; and an engaging hole formed within the other rotor either of the first rotor or the second rotor, for receives an engagement of the rotation regulating member when the relative rotation between the rotors is being regulated; wherein surface treatment is given to an internal surface of the engaging hole and a surrounding area of opening of the engaging hole.

Accordingly, according to the present invention arranged thus above, the invention provides the internal surface of the engaging hole and the surrounding area of the engaging hole with satisfactory mechanical strength or surface hardness enough for resisting deformation of the engaging hole or wear-out of the edge of the engaging hole caused by putting in and out of the rotation regulating member, without inviting an increase in manufacturing cost attended on increasing number of parts and man-hour for press-fitting the parts and lowering in assembly accuracy, as with the conventional valve timing adjusting device. This enhances operation reliability of regulation and release of the relative rotation between the first rotor and the second rotor.

DETAILED DESCRIPTION OF THE PREFERRED EMBODIMENTS

Embodiments of the present invention will now be described hereinafter with reference to the attached drawings.

First Embodiment

Figure 1:
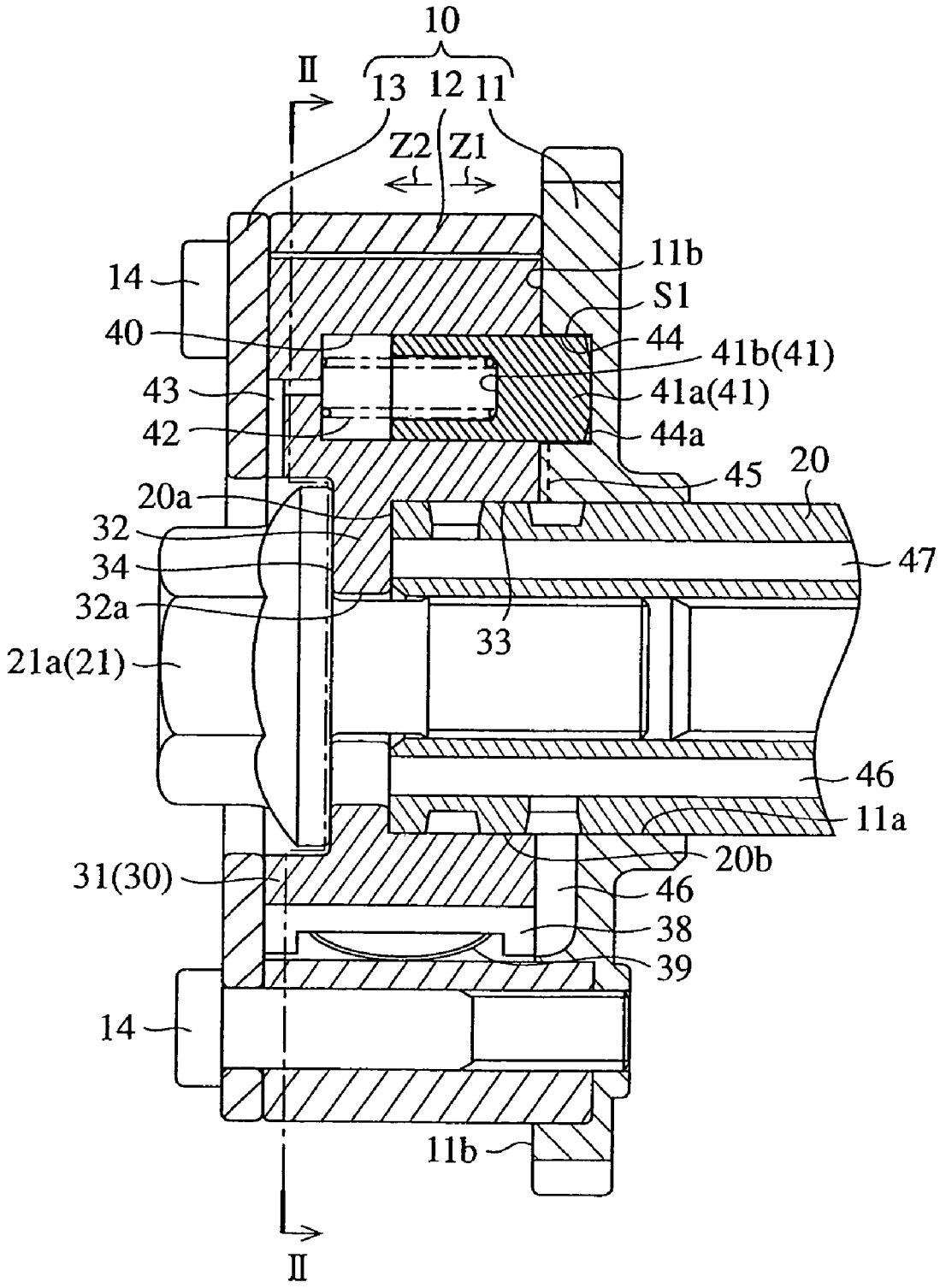
FIG. 1 is an axial sectional view showing an internal structure of a valve timing adjusting device according to a first embodiment of the present invention.
Figure 2:
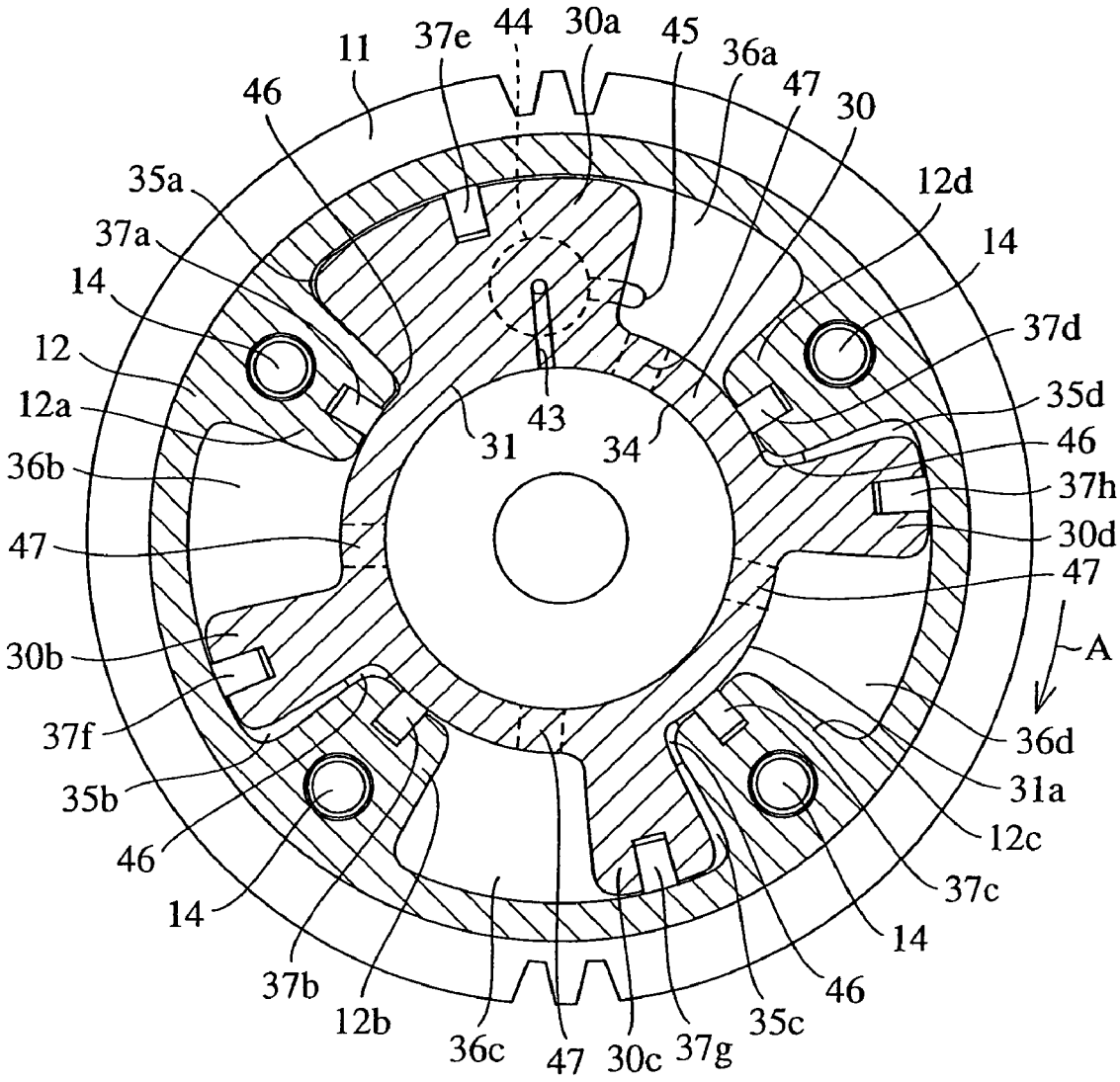
FIG. 2 is a radial sectional view taken along line II—II in FIG. 1.
Figure 3:
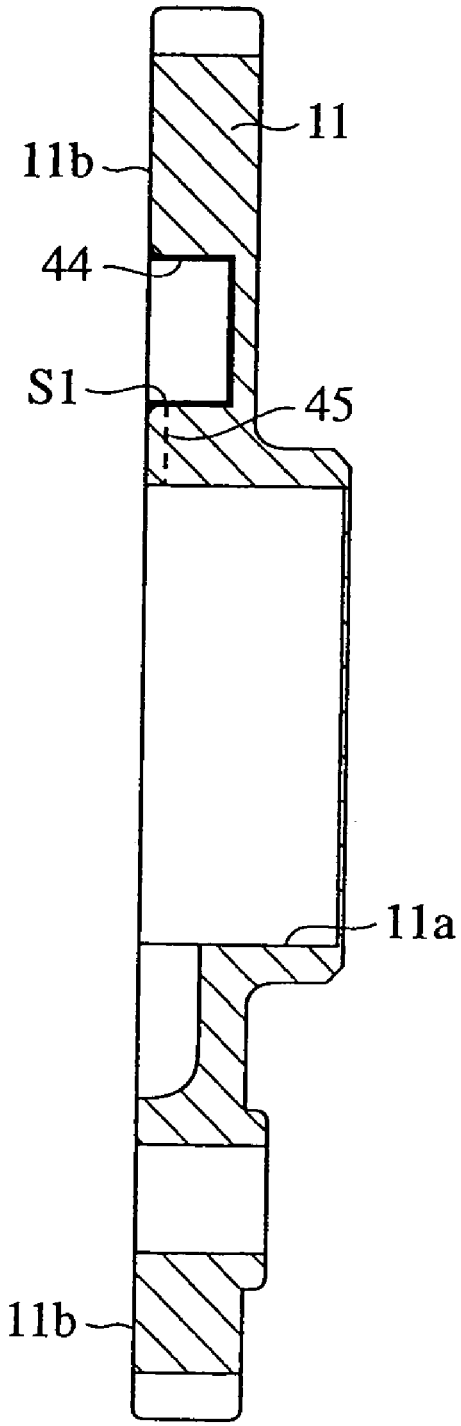
FIG. 3 is an axial sectional view showing a sprocket of the valve timing adjusting device shown in FIG. 1.

FIG. 1 is an axial sectional view showing an internal structure of a valve timing adjusting device according to the first embodiment of the present invention; FIG. 2 is a radial sectional view taken along line II—II in FIG. 1; and FIG. 3 is an axial sectional view showing a sprocket of the valve timing adjusting device shown in FIG. 1.

A valve timing adjusting device 1 is generally composed of a first rotor 10 connected with a crank shaft (not shown) of an engine (not shown) by a power transmitting member (not shown) such as a chain and rotating synchronously with the crank shaft, and a second rotor 30 integrally fixed on an end face of a camshaft 20 of an intake side or an exhaust side camshaft (hereinafter referred to as a camshaft) by a bolt 21 and provided relatively rotatably within the first rotor 10 by a predetermined angle relative to the first rotor. The valve timing adjusting device 1 has, as will be described later, a structure of so-called axial lock, in which a rotation regulating member regulating a relative rotation between the first rotor 10 and the second rotor 30 is provided on the second rotor 30 side slidably in the axial direction of the valve timing adjusting device 1, and an engaging hole permitting an engagement of the rotation regulating member is formed on the first rotor 10 side. As shown in FIG. 2, the valve timing adjusting device is a so-called most-lagged position-lock type device in which rotation of the second rotor 30 is regulated relative to the first rotor 10 at the most lagged position where the relative position of the second rotor 30 relative to the first rotor 10 is most lagged in the rotational direction A of the crankshaft (not shown).

The first rotor 10 is generally composed of a sprocket 11 integrally rotating with the crank shaft (not shown) being subjected to rotation driving force of the crank shaft (not shown), and having inside a bearing 11*a* slidingly contacting a peripheral surface 20*b* located in proximity to an end face 20*a* of the camshaft 20; a case 12 provided adjacent to the sprocket 11, and having inside a plurality of shoes 12*a*, 12*b*, 12*c*, and 12*d* (four shoes in the first embodiment) radially inwardly projecting therefrom and forming a plurality of spaces; and a cover 13 covering the spaces formed within the case 12. These parts are integrally screwed and fastened by bolts 14.

The second rotor 30 is a rotor (hereinafter the second rotor 30 is referred to as "the rotor 30") having a boss 31 integrally screwed and fastened to the end face 20*a* of the camshaft 20 by a bolt 21 as shown in FIG. 2, and a plurality of vanes 30*a*, 30*b*, 30*c*, and 30*d* (four vanes in the first embodiment) radially outwardly projecting from the boss 31 shown in FIG. 1. At the center of the boss 31 is provided with a thin-walled portion 32 having a through hole 32*a* receiving insertion of the bolt 21, at the sprocket 11 side of the thin-walled portion 32 is formed a concave 33 in a cylindrical shape abutting the end face 20*a* of the camshaft 20 and the peripheral surface 20*b* of the end face, and at the case 12 side of the thin-walled portion 32 is provided with a concave 34 in a cylindrical shape receiving a head 21*a* of the bolt 21.

The vane 30*a* of the rotor 30 divides a space formed between the shoe 12*d* and the shoe 12*a* of the case 12 into an advance side hydraulic room 35*a* and a lag side hydraulic room 36*a;* the vane 30*b* divides a space formed between the shoe 12*a* and the shoe 12*b* into an advance side hydraulic room 35*b* and a lag side hydraulic room 36*b;* the vane 30*c* divides a space formed between the shoe 12*b* and the shoe 12*c* into an advance side hydraulic room 35*c* and a lag side hydraulic room 36*c;* and the vane 30*d* divides a space formed between the shoe 12*c* and the shoe 12*d* into an advance side hydraulic room 35*d* and a lag side hydraulic room 36*d.*

As shown in FIG. 2, at tips of the shoes 12*a,* 12*b,* 12*c,* and 12*d* of the case 12 in the first embodiment are provided with seal means 37*a,* 37*b,* 37*c,* and 37*d,* respectively, preventing working fluid from flowing between the advance side hydraulic room 35*a* and the lag side hydraulic room 36*b,* between the advance side-hydraulic room 35*b* and the lag side hydraulic room 36*c,* between the advance side hydraulic room 35*c* and the lag side hydraulic room 36*d,* and between the advance side hydraulic room 35*d* and the lag side hydraulic room 36*a,* respectively, and maintaining pressure within each of the rooms. Moreover, at tips of the vanes 30*a,* 30*b,* 30*c,* and 30*d* of the rotor 30 are provided with seal means 37*e,* 37*f,* 37*g,* and 37*h,* respectively, preventing working fluid from flowing between the advance side hydraulic room 35*a* and the lag side hydraulic room 36*a,* between the advance side hydraulic room 35*b* and the lag side hydraulic room 36*b,* between the advance side hydraulic room 35*c* and the lag side hydraulic room 36*c,* and between the advance side hydraulic room 35*d* and the lag side hydraulic room 36*d,* respectively, and maintaining pressure within each of the rooms. As shown in FIG. 1, the seal means 37*c* is generally composed, for instance, of a seal member 38 made up of flexible resin and a board spring 39 pressing the seal member 38 against a peripheral surface 31*a* of the boss 31 of the rotor 30, and other seal means have the same structures.

In the vane 30*a* of the rotor 30 is formed a lock pin receiving hole 40 extending in the axial direction of the camshaft 20 as shown in FIG. 1 and FIG. 2. The lock pin receiving hole 40 receives a lock pin (rotation regulating member) 41 slidably in the axial direction of the lock pin receiving hole 40. The lock pin is for regulating a relative rotation between the case 12 and the rotor 30 when the engine is stopped or started, and for permitting the relative rotation therebetween when the engine is in operation. The lock pin 41 is a so-called straight pin, and is generally composed of a substantially cylindrical pin body 41*a* in a cylindrical form and a non-penetrating hole 41*b* formed at the bottom of the pin body 41*a* along an axial direction of the pin body 41*a*. A tip of the pin body 41*a* of the lock pin 41 is not a flat surface but a curved surface whose center is somewhat raised in the direction of arrow Z1 compared with its periphery.

Between the bottom of the lock pin receiving hole 40 and the non-penetrating hole 41*b* of the lock pin 41 opposing to the bottom is provided a coil spring 42 continuously urging so as to advance the lock pin 41 in the direction of arrow Z1. Further, at the bottom of the lock pin receiving hole 40 is formed a back pressure drain passage 43 for communicating with the lock pin receiving hole 40 and the concave 34 of the boss 31 via the rotor 30 side end face of the cover 13, and for draining back pressure generated within the lock pin receiving hole 40 to the atmosphere when the lock pin 41 retreated in the direction of arrow Z2.

Meanwhile, as shown in FIG. 3, the rotor 30 side end face 11*b* of the sprocket 11 constituting a part of the first rotor 10 is formed in the form of a flat surface in order to ensure a smooth sliding of the rotor 30 while bringing into contact with the sprocket 11 side end face 30*e* of the rotor 30 to suppress oil leak from each of the above hydraulic rooms. As shown to FIG. 1 and FIG. 3, at the end face 11*b* of the sprocket 11 is provided with a non-penetrating engaging hole 44 in a cylindrical form for receiving an engagement of the lock pin 41 advanced in the direction of arrow Z1 by urging force of the coil spring 42. The clearance between an inner surface of the engaging hole 44 and a peripheral surface of the pin body 41*a* of the lock pin 41 is formed such that the clearance falls within the range from tan 0.3° to tan 0.6°, for instance, where a distance from the center of the valve timing adjusting device to that of the engaging hole is in the range from about 20 mm to about 22 mm, for instance.

In the engaging hole 44, a lock releasing hydraulic room 44*a* is provided between a tip surface (curved surface) of the pin body 41*a* and the bottom of the engaging hole 44 when the pin body 41*a* of the lock pin 41 is engaged into the hole, and is applied lock releasing hydraulic pressure when the lock is released (described later).

Between the engaging hole 44 and the lag side hydraulic room 36*a* is provided a lock releasing oil passage 45 applying lock releasing hydraulic pressure acting on a tip surface of the pin body 41*a* of the lock pin 41 engaged into the engaging hole 44 by way of the end face 11*b* of the sprocket 11 when the lock is released (described later).

At an internal surface of the engaging hole 44, at the end face 11*b* adjacent to opening of the hole, and at a portion adjacent to the engaging hole 44 of the lock releasing oil passage 45, (hereinafter these areas are collectively referred to as a region S1) are given surface treatment for improving their surface hardness. Such surface treatment preferably includes partial quench hardening process by induction hardening. The partial quench hardening process by induction hardening adopted in the first embodiment can be effectuated in a comparatively short time in a prescribed manner which involves limiting the partial quench hardening process to the region S1, applying electromagnetic induction heat to the region S1,and heating to a predetermined quench hardening temperature. This process applies relatively uniform quench hardening to a hole of circular cross-section such as the engaging hole 44. The quench hardening temperature is determined by comprehensively considering a variety of factors such as materials forming the sprocket 11, dimensions of the engaging hole 44, necessary mechanical strength, the relationship between the quench hardening temperature and deformation, and treating time etc.

The reason why the present invention does not adopt a so-called total quench hardening process usually effectuated for processing the whole part like the sprocket 11, for instance, but adopts partial quench hardening process will now be described below. That is, application of the total quench hardening process to a roughed sprocket 11 secures mechanical strength required for a tooth of the sprocket 11 and the engaging hole 44, but deformation will occur all over the sprocket 11. However, the end face 11*b* of the sprocket 11 is required to have sufficient flatness for performing functions of preventing an oil leakage and securing smooth sliding of the rotor 30 as mentioned above. Therefore, this requirement entails execution of finish machining (post-machining) on the whole sprocket 11 for removing deformation. This inflicts incommodity that manufacturing cost is greatly pushed up, as in the case of the conventional valve timing adjusting device. Contrarily, the partial hardening process can enhance surface hardness of only the region S1, and suppress generation of the deformation to a minimum. Grinding by surface grinding (partial finishing)

serves for the deformation generated on the end face 11*b* side of the sprocket 11 out of the region S1 because the end face 11*b* has a flat surface, which incurs no great increase in manufacturing cost.

A first oil passage 46 applying and draining hydraulic pressure in communication with the advance side hydraulic rooms 35*a*, 35*b*, 35*c*, and 35*d*, and a second oil passage 47 applying and draining hydraulic pressure in communication with the lag side hydraulic rooms 36*a*, 36*b*, 36*c*, and 36*d* are provided inside the camshaft 20. The first oil passage 46 and the second oil passage 47 are arranged to be supplied with oil pumped up from an oil pan (not shown) by an oil pump (not shown) via an OCV (not shown), and when the engine is stopped, oil remaining within the advance side hydraulic rooms and the lag side hydraulic rooms is returned to the oil pan (not shown) via the first oil passage 46, the second oil passage 47, and the OCV (not shown).

The operation of the first embodiment will now be described below.

First, when the engine is stopped, oil remaining in the valve timing adjusting device 1, the first oil passage 46, and the second oil passage 47 is returned to the oil pan (not shown) because of inactivation of the oil pump (not shown). At that time, the absence of hydraulic pressure from the lag side hydraulic room 36*a* to the engaging hole 44 located in the valve timing adjusting device 1 via the lock releasing oil passage 45 acts no hydraulic pressure on a tip surface of the pin body 41*b* of the lock pin 41. Therefore, as shown in FIG. 1, the lock pin 41 is advanced in the direction of arrow Z1 by urging force of the coil spring 42 and engaged into the engaging hole 44. Thereby, the relative rotation between the first rotor 10 including the sprocket 11 and the rotor 30 as the second rotor is regulated at the most lagged position (locking state).

Then, when the engine is started and the oil pump (not shown) begins activating, hydraulic pressure is applied to the lag side hydraulic rooms 36*a*, 36*b*, 36*c*, and 36*d* via the OCV (not shown) and the second oil passage 47. When the lag side hydraulic room is applied with ample hydraulic pressure, this lag side hydraulic pressure presses particularly the vane 30*a* of the rotor 30 against the shoe 12*a* of the case 12 and maintains the most lagged position. In this state, the lag side hydraulic pressure acts on a tip surface of the pin body 41*a* of the lock pin 41 from the lag side hydraulic room 36*a* through the lock releasing oil passage 45. Here, when the lag side hydraulic pressure built to the lock releasing oil pressure larger than urging force induced by the coil spring 42, the lock pin 41 retreats in the direction of arrow Z2 due to lock releasing oil pressure, and pulls out of the engaging hole 44 (disengagement). When the lock pin 41 retreats, back pressure generated in the lock pin receiving hole 40 is drained from the back pressure drain passage 43 to the atmosphere, which allows the lock pin 41 to smoothly retreat by the lock releasing oil pressure without being affected by the back pressure. The above disengagement permits a relative rotation between the first rotor 10 including the sprocket 11 and the rotor 30 as the second rotor (lock releasing state).

Subsequently, while the engine is in operation, applying hydraulic pressure commensurate to that of the lag side hydraulic rooms 36*a*, 36*b*, 36*c*, and 36*d* to the advance side hydraulic rooms 35*a*, 35*b*, 35*c*, and 35*d* as well via the OCV (not shown) and the first oil passage 46 to promptly cope with various operational conditions holds the rotor 30 in an intermediate position relative to the first rotor 10 (intermediate position holding control). This appropriately changes the relative position (phase) of the camshaft 20 relative to the crankshaft (not shown) from the intermediate position to the advance side or the lag side, depending on the operational conditions.

Then, when stopping the engine, hydraulic pressure is applied to the lag hydraulic room 36*a*, 36*b*, 36*c*, and 36*d* in response to a control command by the OCV (not shown), oil remaining in the advance side hydraulic rooms 35*a*, 35*b*, 35*c*, and 35*d* is discharged to the oil pan (not shown). This rotates the rotor to the most lagged position relative to the first rotor 10, and opposes the lock pin 41 to the engaging hole 44. In this state, rotations of the engine completely stops, and also the oil pump stops, thereby discharging oil remaining in the lag side hydraulic rooms 36*a*, 36*b*, 36*c*, and 36*d* to the oil pan. When the lag side hydraulic pressure of the lag side hydraulic room 36*a* becomes lower than the lock releasing oil pressure, the lock pin 41 advances in the direction of arrow Z1 by urging force induced by the coil spring 42, thereby engaging the pin into the engaging hole 44, and regulating the relative rotation between the first rotor 10 and the rotor 30 (locking state).

Even though such locking state and lock releasing state are repeated frequently, the engaging hole 44 can be securely prevented from being deformed and worn out an edge of opening of the engaging hole 44 caused by putting in and out of the lock pin 41 because the region S1 including the engaging hole 44 is given surface treatment by partial quench hardening or the like, especially by induction hardening, for instance. Moreover, even if deformation occurs in a part of the end face 11*b* of the sprocket 11 forming apart of the first rotor 10 out of the region S1, the deformation is removed by grinding, especially by surface grinding, thereby securing satisfactory flatness. For this reason, the end face 11*b* can prevent oil from leaking between the rotor 30 and the end face when the engine is in operation, and secure a smooth sliding of the rotor 30.

As mentioned above, according to the first embodiment, since it is arranged such that quench hardening is applied to the region S1 including the engaging hole 44, the arrangement provides the region S1 with mechanical strength or surface hardness enough for resisting deformation of the engaging hole 44 and wear-out of an edge of opening of the engaging hole 44, caused by putting in and out of the lock pin 41, without inviting an increase in manufacturing cost attended on increased number of parts and increased man-hour for press-fitting the parts and lowering in assembling accuracy as with the conventional valve timing adjusting device, thereby enhancing operation reliability of regulation and release of the relative rotation between the first rotor 10 and the second rotor 30.

According to the first embodiment, since it is arranged such that partial quench hardening by induction hardening is applied to the region S1 including the engaging hole 44, the arrangement shortens manufacturing time compared with the conventional valve timing adjusting device, and enables comparatively uniform hardening of a hole of circular cross-section such as the engaging hole 44.

According to the first embodiment, since it is arranged such that the engaging hole 44 opens on the end face 11*b* of the sprocket 11 that is a grindable flat surface, the arrangement secures satisfactory flatness by grinding, especially by surface grinding to remove deformation, even if the deformation occurs over the end face 11*b* in the partial hardening process by induction hardening.

Second Embodiment

Figure 4:
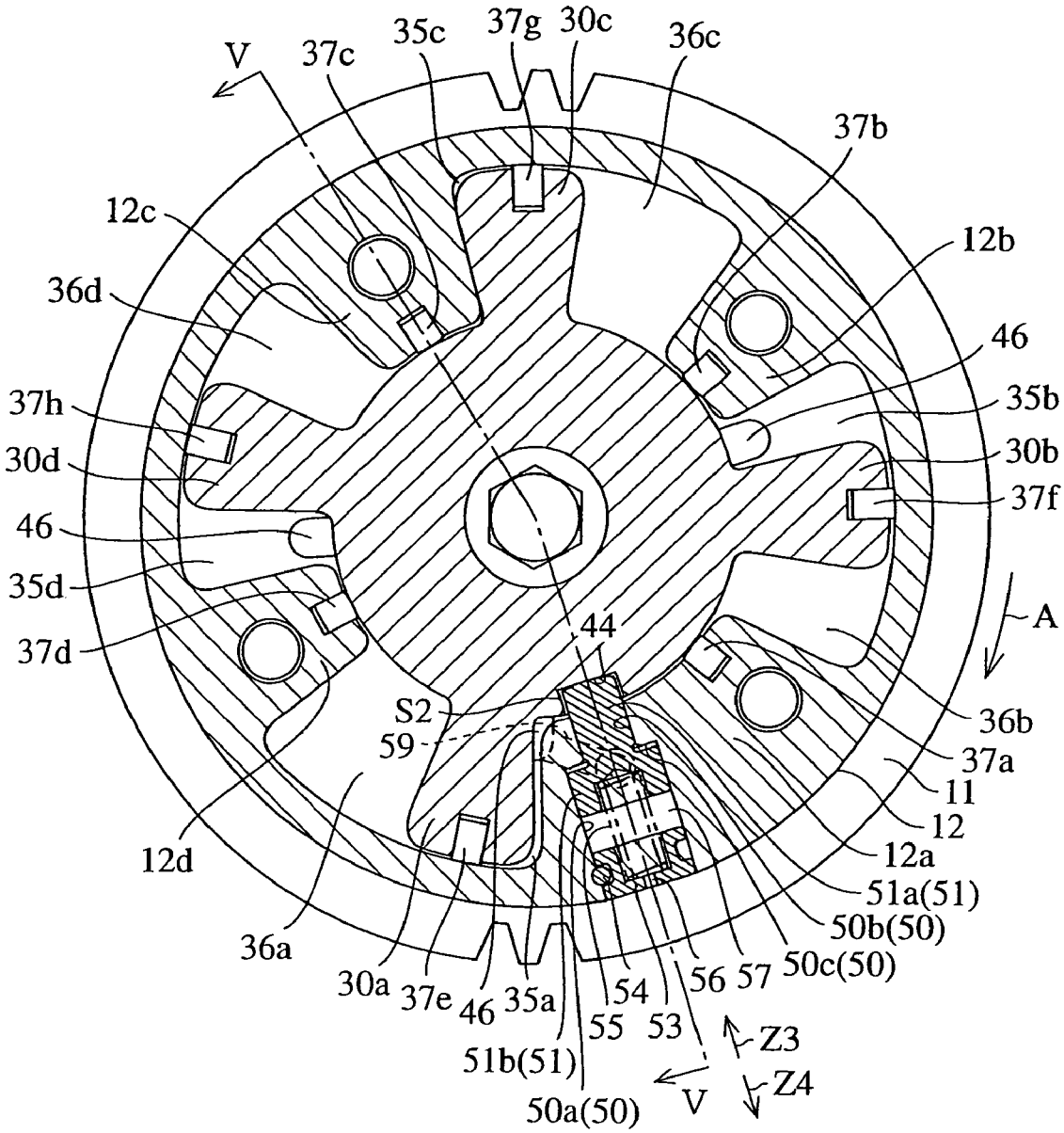
FIG. 4 is a radial sectional view sowing an internal structure of a valve timing adjusting device according to a second embodiment of the present invention.
Figure 5:
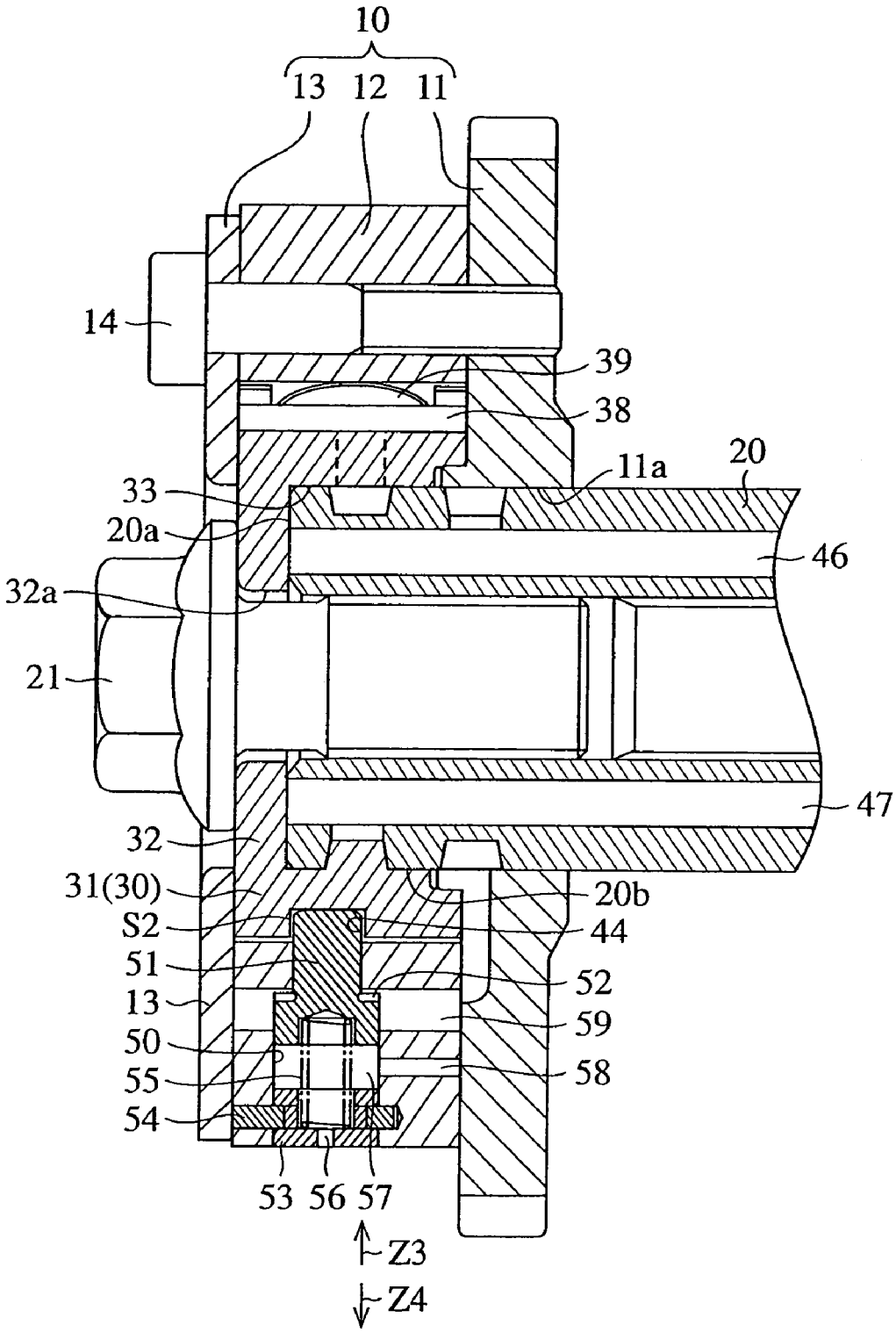
FIG. 5 is an axial sectional view taken along line V—V in FIG. 4.
Figure 6:
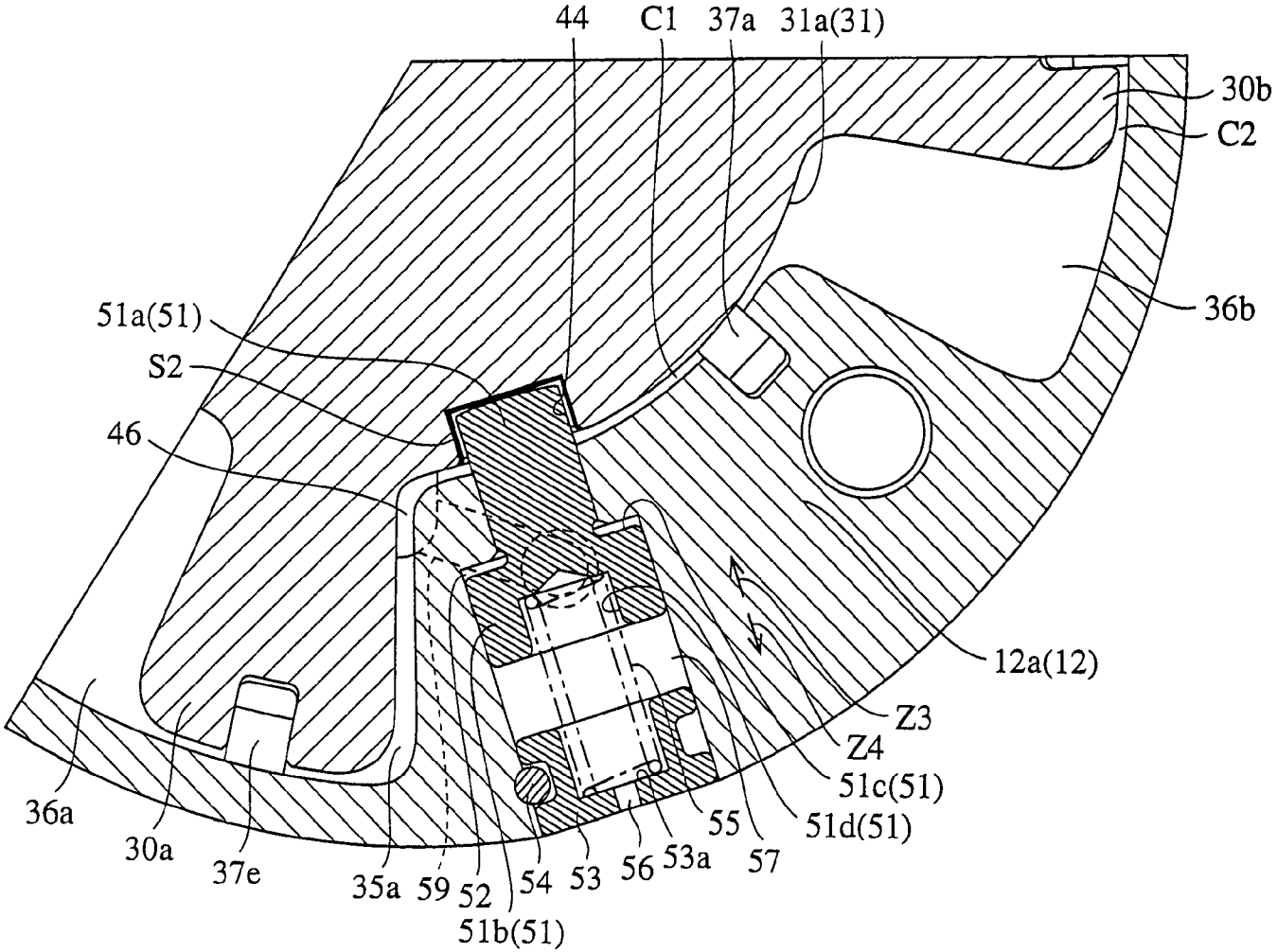
FIG. 6 is an enlarged radial sectional view showing an engaging hole shown in FIG. 4 and a rotation regulating member engaging into the engaging hole.
Figure 7:
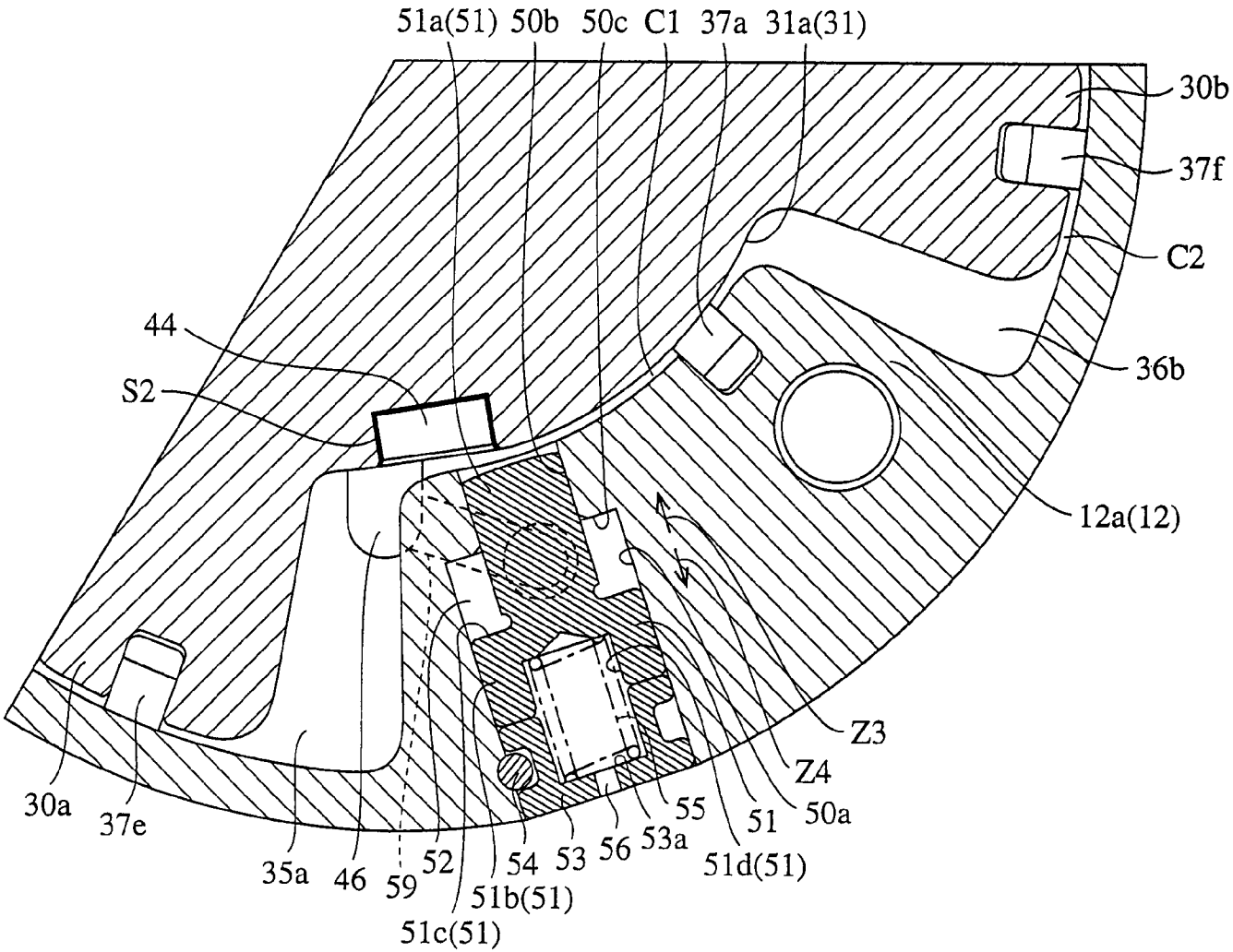
FIG. 7 is an enlarged radial sectional view showing an engaging hole shown in FIG. 4 and a rotation regulating member disengaged from the engaging hole.

FIG. 4 is a radial sectional view showing an internal structure of a valve timing adjusting device according to the second embodiment of the present invention; FIG. 5 is an axial sectional view taken along line V—V in FIG. 4; FIG. 6 is an enlarged radial sectional view showing an engaging hole shown in FIG. 4 and a rotation regulating member engaging into the engaging hole; and FIG. 7 is an enlarged radial sectional view showing the engaging hole shown in FIG. 4 and the rotation regulating member disengaged from the engaging hole. In the second embodiment, the same components commonly used in the first embodiment are designated by the same reference numerals, and therefore explanation thereof is omitted for brevity's sake.

Despite of a valve timing adjusting device that is the most lagged position lock type device as with the first embodiment, the feature of the second embodiment is in that the second embodiment having a so-called radial lock structure, in which the rotation regulating member regulating a relative rotation between a first rotor and a second rotor is provided on the first rotor side slidable in the radial direction of the valve timing adjusting device, and the engaging hole permitting an engagement of the rotation regulating member thereinto is formed on the second rotor side.

The shoe 12*a* of the case 12 is formed with a lock pin receiving hole 50 penetrating through the shoe 12*a* in the radial direction of the case 12. The lock pin receiving hole 50 is generally composed of a large portion 50*a* located at the outside of the case 12, a small portion 50*b* located at the inside of the case 12, and an annular portion 50*c* communicating with the small portion 50*b* and the large portion 50*a*. The lock pin receiving hole 50 is provided slidably with a lock pin 51 (rotation regulating member) along an axial direction of the lock pin receiving hole 50. The lock pin 51 is generally composed of a small portion 51*a* located at the inside of the case 12 and slides within the small portion 50*b* of the lock pin receiving hole 50, a large portion 51*b* located at the inside of the case 12 and slides within the large portion 50*a* of the lock pin receiving hole 50, an annular portion 51*c* communicating with the large portion 51*b* and the small portion 51*a*, a non-penetrating hole 51*d* formed on the bottom of the large portion 51*b*. Between the annular portion 50*c* of the lock pin receiving hole 50 and the annular portion 51*c* of the lock pin 51 is formed a lock releasing hydraulic room 52 to be applied with lock releasing oil pressure.

A bush 53 having a non-penetrating hole 53*a* is press-fitted into the interior of the lock pin receiving hole 50 adjacent to a peripheral surface of the case 12, and the bush 53 is positioned and secured thereon by a shaft 54 inserted along the direction orthogonal to the axial direction of the lock pin receiving hole 50. Between the non-penetrating hole 53*a* of the bush 53 and the non-penetrating hole 51*d* of the lock pin 51 opposed to the non-penetrating hole 53*a* is provided a coil spring 55 continuously urging the lock pin 51 in the direction of arrow Z3. Further, at the bottom of the non-penetrating hole 53*a* of the bush 53 is formed a back pressure drain passage 56 for draining back pressure generated within the lock pin receiving hole 50 to the atmosphere when the lock pin 51 retreated in the direction of arrow Z2.

Moreover, at the shoe 12*a* of the case 12 is provided with an accumulating oil passage 58 for communicating with a back pressure room 57 formed between the lock pin 51 engaged into the engaging hole 44 and the bush 53 while a relative rotation between the first rotor 10 and the rotor 30 is regulated, and the lag side hydraulic room 36*b*. In addition, at the shoe 12*a* of the case 12 is formed with a lock releasing oil passage 59 communicating with the lock releasing hydraulic room 52 and the advance side hydraulic room 35*a*.

Meanwhile, at a peripheral surface 31*a* of the boss 31 of the rotor 30 is formed an engaging hole 44 receiving an engagement of the small portion 51*a* of the lock pin 51 at a position at which the rotor 30 is situated on the most lagged position relative to the first rotor 10. An internal surface of the engaging hole 44 and the peripheral surface 31*a* adjacent to opening of the hole (hereinafter these areas are collectively referred to as a region S2) are given partial quench hardening (surface treatment), especially by induction hardening for improving its hardness as with the first embodiment.

Between the peripheral surface 31*a* of the boss 31 of the rotor 30 and the inner surface of the shoes 12*a*, 12*b*, 12*c*, and 12*d* of the case 12 is left a predetermined clearance C1, which keeps the surfaces from actually slidingly contacting each other. Moreover, leakage of the working fluid between the advance side hydraulic room 35*a* and the lag side hydraulic room 36*b*, between the advance side hydraulic room 35*b* and the lag side hydraulic room 36*c*, between the advance side hydraulic room 35*c* and the lag side hydraulic room 36*d*, and between the advance side hydraulic room 35*d* and the lag side hydraulic room 36*a* are blocked by seal means 37*a*, 37*b*, 37*c*, and 37*d*, respectively. In the same manner, between the inner surface 12*e* of the case 12 and each of the peripheral surfaces of the vanes 30*a*, 30*b*, 30*c*, and 30*d* of the rotor 30 is left a predetermined clearance C2, which keeps both the surfaces from actually slidingly contacting each other. Leakage of working fluid between the advance side hydraulic room 35*a* and the lag side hydraulic room 36*a*, between the advance side hydraulic room 35*b* and the lag side hydraulic room 36*b*, between the advance side hydraulic room 35*c* and the lag side hydraulic room 36*c*, and between the advance side hydraulic room 35*d* and the lag side hydraulic room 36*d* are blocked by seal means 37*e*, 37*f*, 37*g*, and 37*h*, respectively.

In the second embodiment, as mentioned above, the predetermined clearance C1 left between the peripheral surface 31*a* of the boss 31 of the rotor 30 and the inner surface of the shoe 12*a* of the case 12 does without partial finishing such as the grinding carried out in the first embodiment, even if deformation occurs over the peripheral surface 31*a* of the boss 31 in the partial quench hardening process by induction hardening to the region S2, as long as the deformation falls within the clearance C1, thereby whittling down man-hours compared with the first embodiment.

The operation of the second embodiment will now be described below.

First, when the engine is stopped, oil remaining in the valve timing adjusting device 1, the first oil passage 46, and the second oil passage 47 is returned to the oil pan (not shown) because of inactivation of the oil pump (not shown). At that time, in the absence of the hydraulic pressure from the advance side hydraulic room 35*a* to lock releasing hydraulic room 52 located within the valve timing adjusting device 1 acts no hydraulic pressure on the circular ring 51*c* of the lock pin 51. Therefore, as shown FIG. 4, FIG. 5, and FIG. 6, the lock pin 51 advances in the direction of arrow Z3 by urging force of the coil spring 55 and engaged into the engaging hole 44. This regulates a relative rotation between the first rotor 10 including the sprocket 11 and the rotor 30 as the second rotor at the most lagged position (locking state).

Then, when the engine is started and the oil pump (not shown) begins activating, the hydraulic pressure is applied to the lag side hydraulic room 36*a,* 36*b,* 36*c,* and 36*d* via the OCV (not shown) and the second oil passage 47. Here, back pressure generated by applying the lag side hydraulic pressure of the lag side hydraulic room 36*b* to the back pressure room 57 through the accumulating oil passage 58 contributes to accidental disengagement of the lock pin 51 from the engaging hole 44 in collaboration with urging force of the coil spring 55.

Subsequently, when the hydraulic pressure begins applying to the advance side hydraulic rooms 35*a,* 35*b,* 35*c,* and 35*d* commensurate to that of the lag side hydraulic rooms 36*a,* 36*b,* 36*c,* and 36*d* via the OCV (not shown) and the first oil passage 46, the advance side hydraulic pressure from the advance side hydraulic room 35*a* is also applied to the lock releasing oil pressure room 52 via the lock releasing oil passage 59. When the advance side hydraulic pressure built to the lock releasing oil pressure larger than the total sum of urging force of the coil spring 55 and back pressure, the lock pin 51 retreats in the direction of arrow Z4 by lock releasing oil pressure, and pulls out of the engaging hole 44 (disengagement). Here, at the time of retreat of the lock pin 51, when the accumulating oil passage 58 is closed by a peripheral surface of the large portion 51*b* of the lock pin 51, back pressure generated within the lock pin receiving hole 50 is efficiently drained from the back pressure drain passage 56 to the atmosphere, which allows the lock pin 51 to smoothly retreat by the aid of the lock releasing oil pressure without being affected by the back pressure after the accumulating oil passage 58 is closed. The disengagement permits a relative rotation between the first rotor 10 including the sprocket 11 and the rotor 30 as the second rotor (lock releasing state).

As mentioned above, according to the second embodiment, it is arranged such that partial quench hardening by induction hardening is applied to the engaging hole 44 formed in the peripheral surface 31*a* of the boss 31 of the rotor 30 opposed to the shoe 12*a* of the case 12 through the clearance C1. This provides the region 2 with satisfactory mechanical strength or surface hardness enough for resisting deformation of the engaging hole 44 and wear-out of an edge of opening of the engaging hole 44 caused by putting in and out of the lock pin 51, without inviting an increase in manufacturing cost attended on increased number of parts and increased man-hour for press-fitting the parts and lowering in assembling accuracy as with the conventional valve adjusting device. In addition, this dispenses with partial finishing such as the grinding carried out in the first embodiment, even if deformation occurs over the peripheral surface 31*a* of the boss 31, as long as the deformation falls within the clearance C1, thereby paring down the man-hour compared with the first embodiment.

While in the second embodiment, the engaging hole 44 is formed on the rotor 30 side as the second rotor. However, the present invention is also applicable to a structure in which the engaging hole 44 is formed on the first rotor 10 side.

Third Embodiment

The feature of the third embodiment is in that an oxide film forming process is adopted as surface treatment to an internal surface of the engaging hole and a surrounding area of opening of the engaging hole (region) in the first embodiment or the second embodiment. That is, applying the oxide film forming process such as the "Alumite" (registered trademark) process to the internal surface and the surrounding area of opening of the engaging hole formed in either of the first rotor and the second rotor provides the region with satisfactory mechanical strength or surface hardness enough for resisting deformation of the engaging hole and wear-out of an edge of opening of the engaging hole caused by putting in and out of the rotation regulating member.

Here, the Alumite (registered trademark) process is a well-known surface treatment technology dedicated to anodization of aluminum to form a corrosive oxide film thereover when the member in which the engaging hole is formed is aluminum. When applying the Alumite (registered trademark) process to the member, an electrolytic solution such as an aqueous solution of oxalic acid, sulfuric acid or chromic acid, for instance, is put into the engaging hole, and the electrolytic process is performed. Immediately after the electrolysis treatment, boiling water or superheated steam is applied to porous aluminum oxide ($\alpha$-$Al_2O_3$) formed over a surface of the region to thereby seal the porous aluminum oxide in the engaging hole. This forms thereover boehmite ($\gamma$-$Al_2O_3.H_2O$) film being excellent in corrosion resistance, and having high mechanical strength and surface hardness.

As mentioned above, according to the third-embodiment since it is arranged such that oxide film-forming treatment is applied the region, the third embodiment provides the region with satisfactory mechanical strength or surface hardness enough for resisting deformation of the engaging hole and wear-out of an edge of opening of the engaging hole caused by putting in and out of the rotation regulating member, without inviting an increase in manufacturing cost attended on increased number of parts and increased man-hour for press-fitting and lowering in assembling accuracy like the conventional valve timing adjusting device, as with the first and second embodiments. This enhances operation reliability of regulating and release of the relative rotation between the first rotor and the second rotor.

While descriptions are given on the valve timing adjusting device of the most lagged position lock type in each of the above-mentioned embodiments, the present invention is also applicable to the most advanced position lock type and the intermediate position lock type in lieu thereof.

What is claimed is:

1. A valve timing adjusting device comprising:

a first rotor rotating synchronously with a crankshaft of an internal combustion engine;

a second rotor secured on an end face of an intake camshaft of the engine or an exhaust camshaft, and provided relatively rotatably within the first rotor by a predetermined angle;

a rotation regulating member provided within one of the first rotor and the second rotor, for regulating a relative rotation between the first rotor and the second rotor when the relative position reaches a predetermined position; and an engaging hole having an internal surface that is formed from the other one of the first rotor and the second rotor, for receiving an engagement of the rotation regulating member when the relative rotation between the rotors is being regulated; wherein surface treatment is given to the internal surface of the engaging hole and a surrounding lip area of an opening of the engaging hole, and wherein the surface treatment does not extend past a lip of the engaging hole, such that an additional area is provided on the one of the first rotor and the second rotor having the engaging hole that encircles said surrounding area and does not include the surface treatment.

2. The valve timing adjusting device according to claim 1, wherein the surface treatment is oxide-film forming treatment.

3. The valve timing adjusting device according to claim 1, wherein the surface treatment is quench hardening.

4. The valve timing adjusting device according to claim 3, wherein the engaging hole to be hardened is formed such that the hole opens on a cuttable flat surface.

5. The valve timing adjusting device according to claim 3, wherein the quench hardening is partial quench hardening by induction hardening.

6. The valve timing adjusting device according to claim 1, wherein surface treatment is given to the engaging hole formed in either one face of the first rotor or that of the second rotor opposing the one face of the first rotor with a clearance left therebetween.

* * * * *